United States Patent [19]

Cleavenger

[11] 4,422,596

[45] Dec. 27, 1983

[54] DISPENSING REEL

[75] Inventor: Thomas H. Cleavenger, Chicago, Ill.

[73] Assignee: Cleavenger Associates Inc., Chicago, Ill.

[21] Appl. No.: 424,064

[22] Filed: Sep. 27, 1982

[51] Int. Cl.[3] ..... B65H 49/00

[52] U.S. Cl. ..... 242/129; 242/54 R; 242/110.2

[58] Field of Search ..... 242/54 R, 110.1, 110.2, 242/127, 129, 129.5, 115; 314/68, 69

[56] References Cited

U.S. PATENT DOCUMENTS

| | | | |
|---|---|---|---|
| 2,087,928 | 7/1937 | Spencer et al. | 242/72 |
| 2,372,730 | 4/1945 | Morgan | 242/129 |
| 2,819,854 | 1/1958 | Romig | 242/129 |
| 3,125,310 | 3/1964 | Marqulis | 242/129 X |
| 3,395,308 | 7/1968 | Meyer | 314/68 |
| 3,446,456 | 5/1969 | Wyle | 242/129 |
| 3,731,888 | 5/1973 | Cassel et al. | 242/129 |
| 3,840,713 | 10/1974 | Carpentier | 191/12.2 R |

*Primary Examiner*—Leonard D. Christian
*Attorney, Agent, or Firm*—Edward C. Threedy

[57] ABSTRACT

A dispensing reel for coils of plastic pipe and tubes wherein the coils are positioned on and retained between pairs of rollers arranged in series of open core retention units with each unit having a releasable coil captive latch which, when in an open condition, permits the installation of an open core coil upon the retention units of the reel.

6 Claims, 3 Drawing Figures

DISPENSING REEL

SUMMARY OF THE INVENTION

The object of this invention is to provide an industrial type dispensing reel having a large coil capacity. Specifically, the object of the invention is to provide a dispensing reel that can be easily loaded, permitting a simple pay out operation, and readily accept a rewind of the coil if required.

The dispensing reel of this invention consists of a vertically disposed skeleton frame which provides a stabilized base as well as a support for a series of open core coil retention units. Each of these retention units consists of a pair of spaced apart horizontally disposed rollers adapted to receive therebetween a segment of the open core coil of the plastic pipe or tube. Each of the retention units includes a releasable latch which extends between the open ends of each roller in each pair of rollers so that such latch in its operative position will capture a segment of the coil between the pair of rollers of its unit. When the releasable latch is in an opened or unlatched position the open core coil may be readily and simply placed within each of the retention units and be in a position from which the pipes or tubes may be readily dispensed in a continuous movement with the coil rotating about a center axis centrally located relative to each of the retention units.

A dispensing reel of the type disclosed herein is economical in manufacture and simple in construction and operation, and one which can be highly portable so as to meet the needs of various industrial uses.

Other objects will appear hereinafter and be made apparent from an understanding of the disclosed invention.

BRIEF DESCRIPTION OF THE DRAWINGS

The invention will be best understood by reference to the accompanying drawing which illustrates the preferred embodiment of the invention by which the stated objects are achieved, and in which.

GENERAL DESCRIPTION

Figure 1:
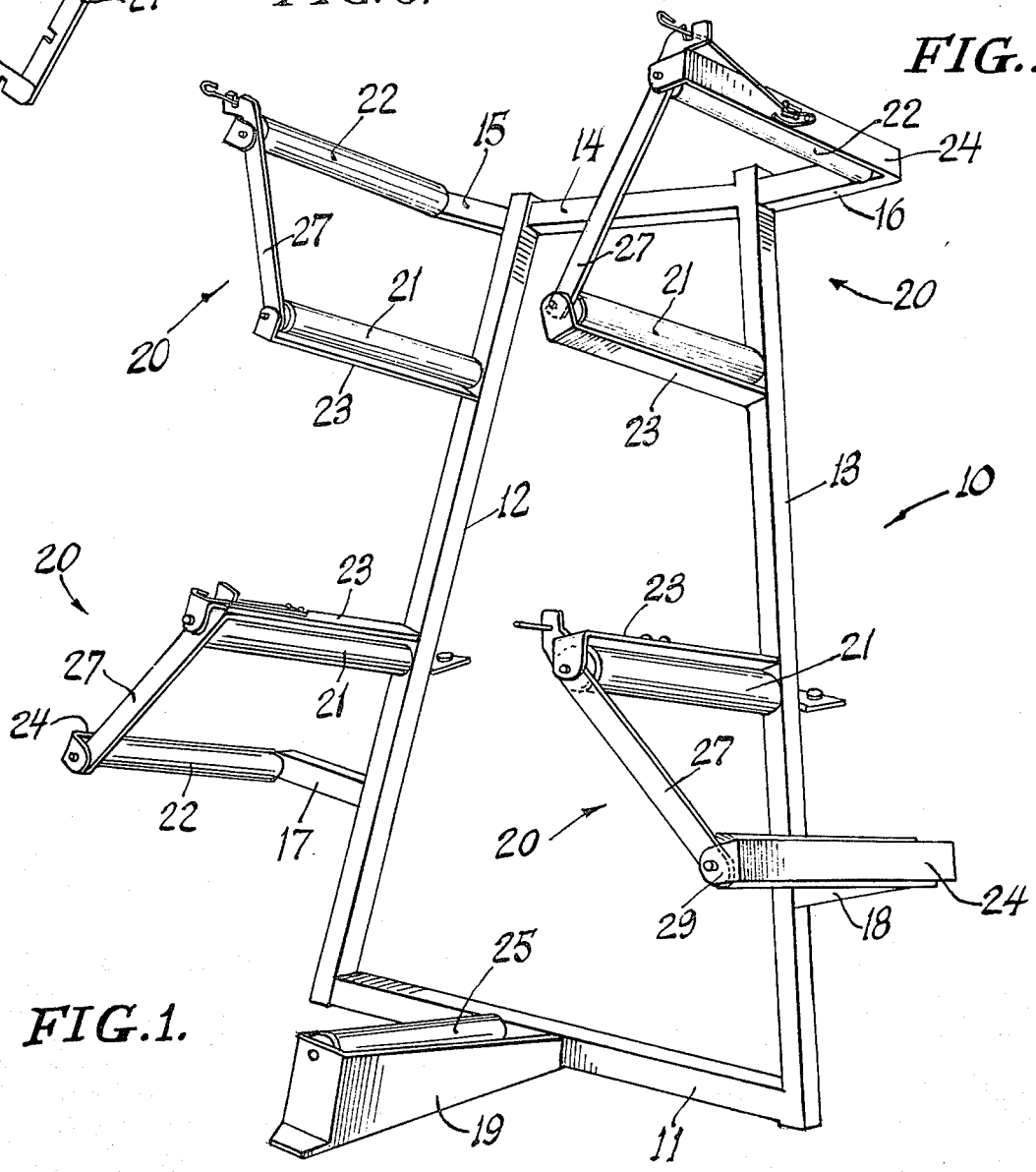
FIG. 1 is a perspective view of the dispensing reel of the invention.

As illustrated in FIG. 1, the dispensing reel 10 is constructed from a skeleton frame which includes a base 11, the ends of which support vertically disposed converging supporting trunks 12 and 13. The upper ends of the vertical trunks 12 and 13 are joined by a connecting bar 14 which includes a set of oppositely extending upwardly inclined side bars 15 and 16. A second pair of corresponding side bars 17 and 18 extend in an inclined relation relative to the trunks 12 and 13, adjacent the base 11 of the skeleton frame of the reel 10. Cooperating with the base 11 is a foot plate 19 which extends in a horizontal plane at right angles from the base 11, as shown in FIGS. 1 and 2.

The reel 10 includes a series of open core coil retention units 20. Each of these retention units 20 consists of a pair of spaced apart rollers 21 and 22. The rollers 21 of each of the units 20 is contained within a substantially U-shaped limb 23 which is supported by, and extends laterally from, the vertically extending trunks 12 and 13.

The cooperating roller 22 of each of the retention units 20 are housed in a like U-shaped limb 24 that extend laterally from the ends of the inclined side bars 15–16 and 17–18, in a spaced parallel relation to the rollers 21.

Figure 2:
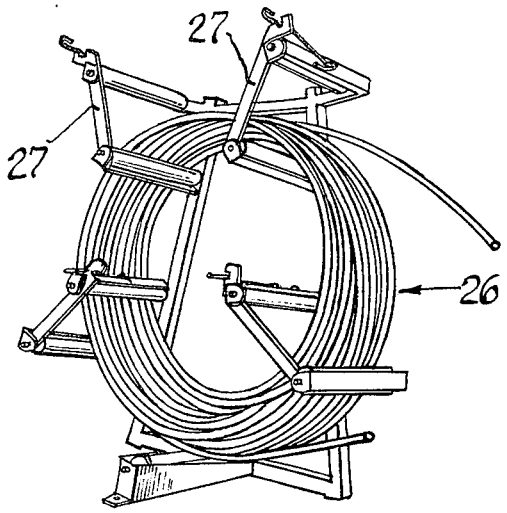
FIG. 2 is a perspective view of the dispensing reel of this invention with a coil of plastic piping or tubing mounted thereon.

A cooperative roller 25 is supported by, and is exposed above, the foot plate 19, as shown in FIGS. 1 and 2.

To maintain the open core coil 26 upon the dispensing reel 10, each of the retention units 20 is provided with a coil captive latch 27. Each of these latches 27, and their associated components, are identical, and therefore the following description of the same applies to each of them.

Figure 3:
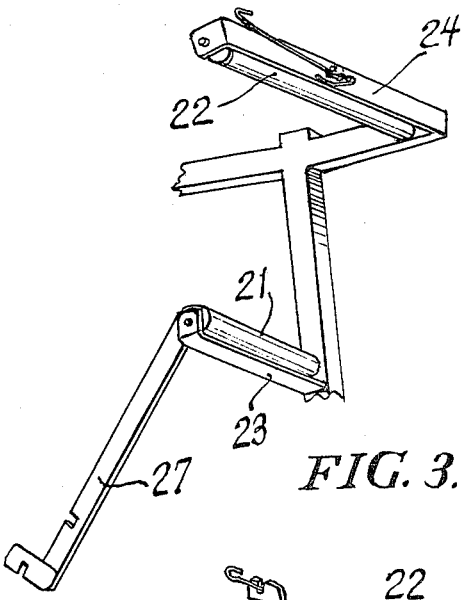
FIG. 3 is a fragmentary detailed view of the releasable coil captive latch as employed in this invention.

Referring to FIG. 3, there is shown the captive latch 27 in its unlatched position. FIG. 3 discloses the latch 27 as it is related to the uppermost retention units 20 provided by the reel 10. As such, the latch 27 has one end pivotally connected to the outermost arm 28 of the U-shaped limbs 23. The latch 27 as associated with the two lowermost retention units 20 will have its corresponding one end pivotally connected to the outermost arm 29 of the U-shaped limbs 24.

The free end of the latch 27 is provided with a latch plate 30 which extends at a right angle to the longitudinal length of the latch 27 and which has one of its longitudinal edges notched, as at 31. It should also be noted that each of the latches 27 adjacent to the latch plates 30 has one of its longitudinal edges notched, as at 32.

As shown in FIG. 3, the corresponding limbs 24 of each of the retention units 20 has mounted thereon, by a clip 33, a spring biased latch 34. A corresponding latch 34 is provided by the like limbs 23 of the lowermost retention units 20, as clearly shown in FIGS. 1 and 2. The free end of the latch 34 is adapted to be biased into the notch 31 formed in the latch plate 30 of the latch 27 when such latch is rotated into its closed position, as shown in FIG. 2, where it will capture a portion of the open core coil of the plastic pipe or tube onto the reel 10. The notch 32 formed in the latch 27 will receive the supporting shaft of the associated roller 22 when the latch is in its operative position, as shown in FIGS. 1 and 2.

From the foregoing it is apparent that there has been described a dispensing reel 10 which can be simply loaded with an open core coil of piping or tubing which then can be latched within strategically located retention units from which the piping or tubing can be readily dispensed in a pay out operation, or upon which a coil can be readily rewound if required. The cooperating spaced apart rollers of each of the retention units maintain a uniform inner diameter of the open core coil during such operation, while at the same time by reason of their placement relative to each other, will permit the reel to accommodate a large coil capacity.

The dispensing reel of this invention is self-supporting, or it may be readily attached to a movable vehicle such as to a trailer bed of a truck and the like. As such, the dispensing reel will take up a minimal space, yet be highly effective in a transporting, storage and dispensing of coil materials associated therewith.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described the invention, what I claim as new and desire to protect by Letters Patent is:

1. A large capacity dispensing reel for coils of plastic pipe and tubes and the like comprising, (a) a skeleton frame comprising a base and a pair of vertically extending converging trunk members, (b) a series of upwardly inclined limbs extending in opposite directions from said trunk members, (c) a plurality of open core coil retention units supported by said trunks and said limbs and extending to one side of said frame, (d) said retention units comprising open core coil supporting members, (e) a movable coil latch arm provided by each of said retention units for retaining a segment of the coil within each of said retention units, and (f) a releasable latch for locking said latch arms in position for retaining the open core coil within said retention units.

2. A dispensing reel as defined by claim 1, wherein said releasable latch comprises a biased elongated wire spring having a free end adapted to be biased upon said latch arm for retaining a segment of the coil within each of said retention units.

3. A dispensing reel as defined by claim 1, wherein each of said open core coil retention units comprises a pair of spaced apart rollers extending in parallel staggered relation from one side of said frame with a segment of the coil adapted to be placed therebetween when mounted upon said reel.

4. A dispensing reel as defined by claim 1, including a base foot extending from one side of said base in parallel relation to said retention units so as to be positioned beneath the coil placed therein for supporting said frame in an upright position.

5. A dispensing reel as defined by claim 4, wherein said releasable latch comprises a biased elongated wire spring having a free end adapted to be biased upon said latch arm for retaining a segment of the coil within each of said retention units.

6. A dispensing reel as defined by claim 4, wherein each of said open core coil retention units comprises a pair of spaced apart rollers extending in parallel staggered relation from one side of said frame with a segment of the coil adapted to be placed therebetween when mounted upon said reel.

* * * * *